US005127868A

United States Patent [19]

Smollar

[11] Patent Number: 5,127,868

[45] Date of Patent: Jul. 7, 1992

[54] HOLDER AND CONTROLLER FOR YO-YO TYPE TOYS

[75] Inventor: Marvin Smollar, Northbrook, Ill.

[73] Assignee: Marchon, Inc., Vernon Hills, Ill.

[21] Appl. No.: 641,767

[22] Filed: Jan. 16, 1991

[51] Int. Cl.[5] ..... A63H 1/30

[52] U.S. Cl. ..... 446/250; 446/247; 446/236

[58] Field of Search ..... 446/236, 247, 248, 249, 446/250, 251, 252, 253, 254

[56] References Cited

U.S. PATENT DOCUMENTS

| | | | |
|---|---|---|---|
| 1,006,840 | 10/1911 | Floto | 446/250 |
| 1,419,690 | 6/1922 | Samour | 446/248 |
| 1,864,318 | 6/1932 | Powell | 446/250 |
| 2,662,337 | 12/1953 | Burkey | 446/254 |
| 3,545,124 | 12/1970 | Schwartz | 446/250 |
| 4,273,275 | 6/1981 | Vadnais | 446/250 X |
| 4,418,494 | 12/1983 | Ghandour | 446/250 |

*Primary Examiner*—Robert A. Hafer
*Assistant Examiner*—Sam Rimell
*Attorney, Agent, or Firm*—Laff, Whitesel, Conte & Saret

[57] ABSTRACT

A device for holding or controlling a bandalore or yo-yo type toy is provided having a resilient, rubberized or plastic o-ring and a string. The string is permanently connected to the o-ring and when passed through the o-ring, a loop is created for the user's finger thereby allowing the user to hold and control the toy. Additionally, the user may pass a finger directly through the o-ring to hold and control the bandalore or yo-yo type toy.

6 Claims, 2 Drawing Sheets

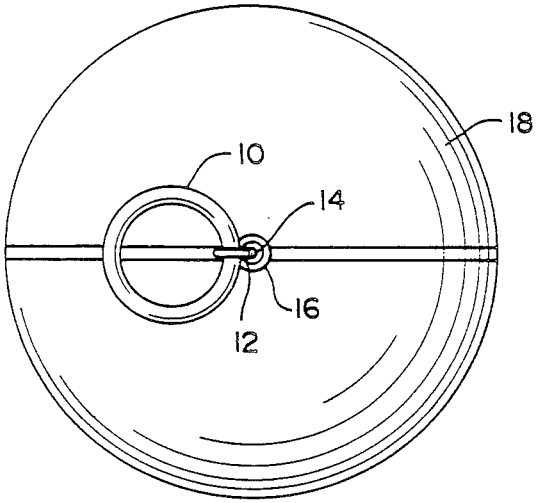
Fig. 7
Fig. 8
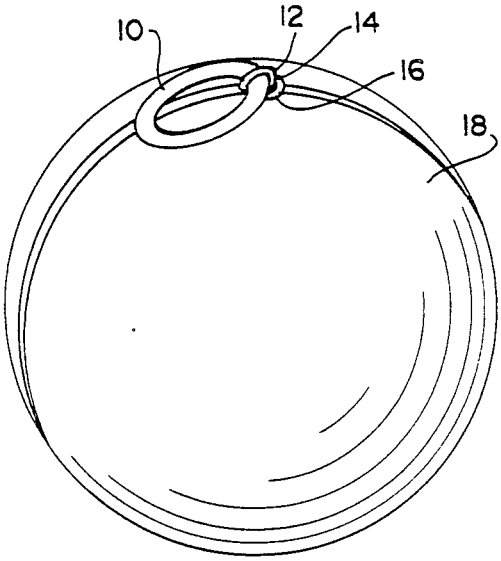
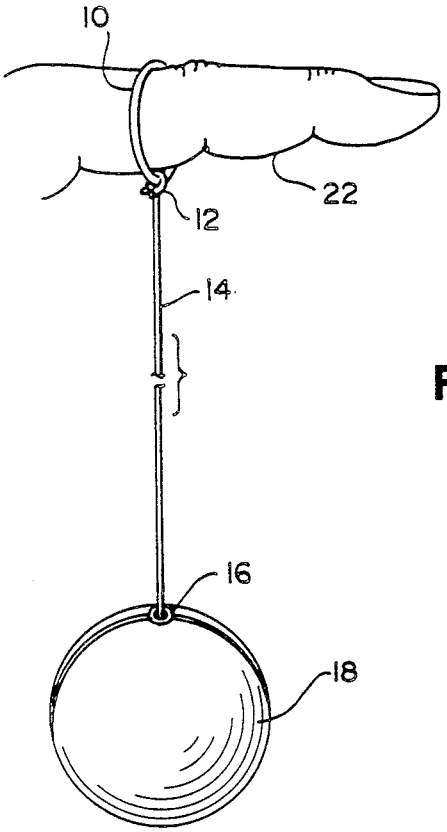
Fig. 9

HOLDER AND CONTROLLER FOR YO-YO TYPE TOYS

FIELD OF THE INVENTION

This invention relates to a device to hold or control a toy. More particularly, this invention relates to a device to hold or control a toy that one manually makes rise and fall from a string, namely a bandalore or yo-yo.

BACKGROUND OF THE INVENTION

For many years and in many cultures, the bandalore or yo-yo, as it is more commonly known, has been a popular toy. It may be crafted out of many different materials, and while the basic construction of the yo-yo is simple, there are a number of variations on the overall design that have been created and sold to the general public. Throughout these variations, however, the designers have consistently used a string of some sort to allow the user of the yo-yo to hold and control the toy. The string is attached at one end of the yo-yo and at the other end to the user of the toy by way of a slip knot tied around a finger.

While the use of the slip knot connection has been the most common way one holds and controls the yo-yo, there are inherent problems in using a string tied to a finger. For example, the slip knot has a natural tendency to become tighter and tighter around the user's finger during use, thus cutting off circulation and making the user uncomfortable. Further, the slip knot itself can become tangled around itself or the yo-yo; or, it may become untied, forcing the user to untangle or re-tie the knot to continue using the toy.

Accordingly, an object of the present invention is to provide a connector or holder for a yo-yo or bandalore which will significantly improve circulation in the user's fingers when the toy is being used.

Another object of the present invention is to provide a connector or holder for a yo-yo or bandalore which will remain tangle-free during use.

Another object of the present invention is to provide a connector or holder for a yo-yo or bandalore which will need no re-tying in order to continue using the toy.

Another object of the present invention is to provide a connector or holder for a yo-yo or bandalore which will assist in the upward return of the toy.

Another object of the present invention is to provide a connector or holder for a yo-yo or bandalore which will prevent the toy from becoming useless due to the string and holder being pulled into the inner hub or housing member of the yo-yo.

A further object of the present invention is to provide a connector or holder for a yo-yo or bandalore which will facilitate an overall ease of usage of the toy.

Additional objects and advantages will become apparent from the following description and the drawings.

SUMMARY OF THE INVENTION

The present invention comprises a structure that accomplishes the foregoing objects by providing a resilient, rubberized or plastic o-ring, which is attached or tied to one end of a string. The other end of the string is attached to the yo-yo. A loop of the string is then passed through the o-ring and the user puts a finger through the loop so that the user can hold and control the movement of the yo-yo. The o-ring could also be sized so that the user's finger is inserted directly through the o-ring.

When the toy is manually thrown downward, the tension in the string from throwing the yo-yo causes the o-ring and string to tighten around the user's finger. The o-ring itself, being a resilient, rubberized plastic ring, will bend around and conform to the shape of the user's finger. Upon the upward return of the yo-yo, the tension in the string lessens, thus causing the o-ring to return to its original shape and allow the string to loosen around the user's finger. Through the combination of the tightening and loosening of the o-ring and string, and the deformation and returning to original shape of the o-ring, an equal balance of pressure on the user's finger is created. This equal pressure allows continued use of the toy without discomfort or loss of circulation.

In the present invention, the string and o-ring assembly are pre-connected. Therefore, one need only pass a loop of the string through the o-ring to allow the user to hold the toy. Because the user need not tie any new knots, but only slip a finger through a loop in the string, there will be no knots to become tangled or untied.

The above, as well as other objects and advantages of the invention, will become apparent from the following detailed description of the invention, reference being made to the accompanying drawings.

BRIEF DESCRIPTION OF THE DRAWINGS

A preferred embodiment of the invention is the holder or connector illustrated in the accompanying drawings of figures, wherein:

FIG. 7 is a plan view of a preferred embodiment of the invention while the full length of the string has been recoiled into the inner hub or housing of the bandalore or yo-yo type toy;

FIG. 8 is a perspective view of a preferred embodiment of the invention while the full length of the string has been recoiled into the inner hub or housing of the bandalore or yo-yo type toy; and FIG. 9 is a perspective view of an additional embodiment of the invention attached to the bandalore depicting the user's finger passing directly through the flexible o-ring and not through the o-ring/loop connection.

DETAILED DESCRIPTION OF THE INVENTION

The invention provides the user of a bandalore, or yo-yo type toy, with a connector or holder which is less restricting to the user's finger, less likely to become tangled or knotted, which will assist in the upward return of the toy and which will prevent the string and o-ring from being pulled into the inner housing of a bandalore or yo-yo type toy. Like parts of this invention are indicated by like reference numbers.

Figure 1:
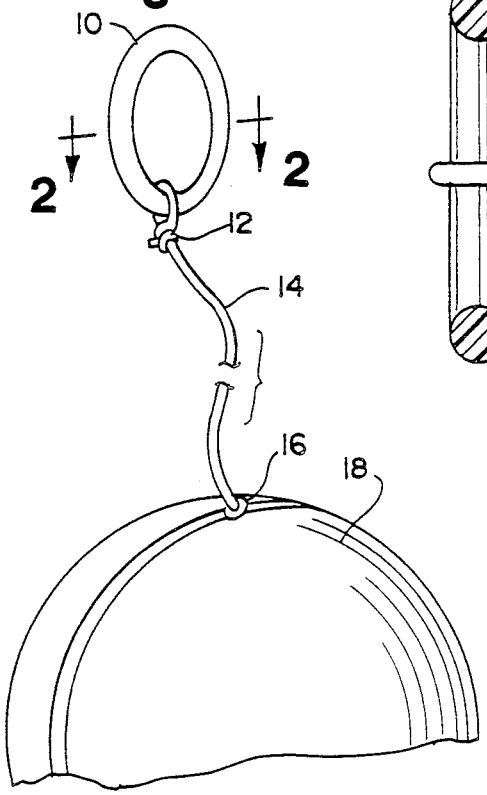
FIG. 1 is a perspective view of a preferred embodiment of the invention connected to a bandalore-type toy, or yo-yo, and the o-ring and string connection before the loop has been made by the string.
Figure 5:
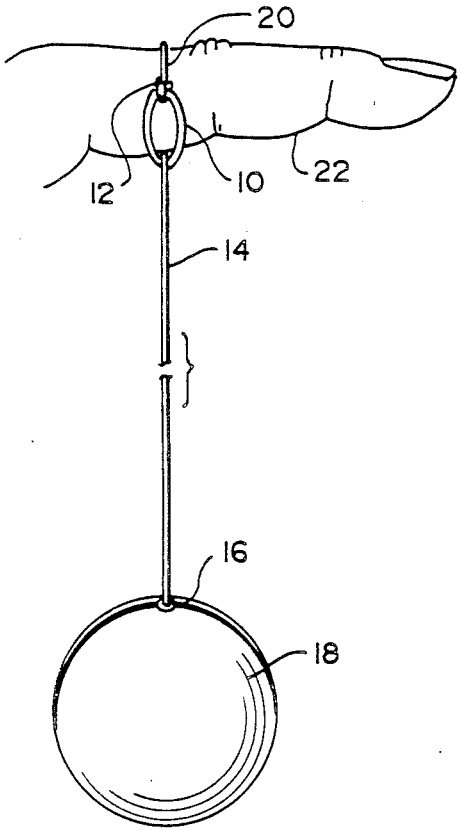
FIG. 5 is a perspective view of a preferred embodiment of the invention attached to the bandalore and connected to the user's finger, depicting the bandalore in a downward motion, the string in tension and the flexible o-ring tightly forming around the user's finger.
Figure 6:
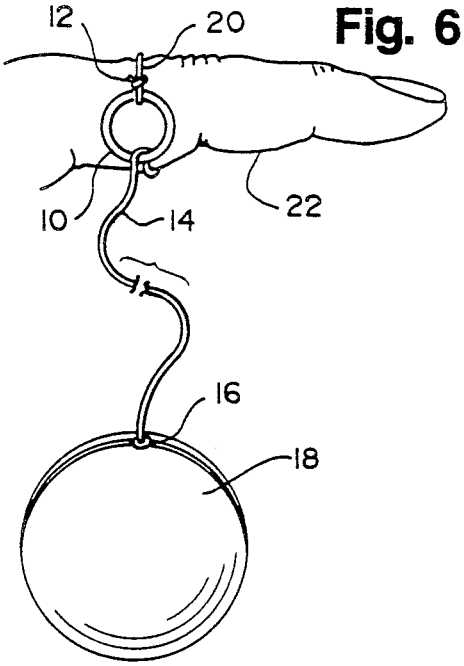
FIG. 6 is a perspective view of a preferred embodiment of the invention attached to the bandalore and connected to the user's finger, depicting the bandalore in an upward motion, the string relaxed and the flexible o-ring loosely fitting around the user's finger.

As shown in FIGS. 1, 5 and 6, a device to hold or control a bandalore constructed in accordance with the teachings of this invention, comprises a resilient, rubberized or plastic o-ring 10 and a string 14. The string 14 is attached to the resilient rubberized or plastic o-ring 10 at one end by means of a knot or like permanent connection 12. The other end of the string 14 passes through an opening 16 between the two halves of the bandalore and is attached to a center post (not shown) in the bandalore or yo-yo type toy 18.

Figure 2:
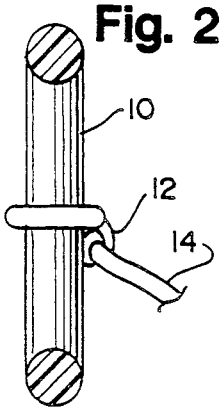
FIG. 2 is a cross section, taken along line 2—2, of a preferred embodiment of the invention, as shown in FIG. 1, depicting the o-ring/string permanent connection and the string prior to the making of the loop.
Figure 3:
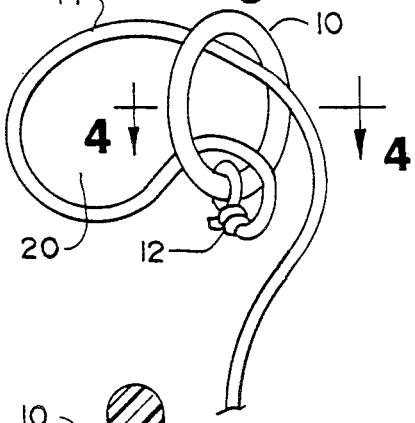
FIG. 3 is a perspective of a preferred embodiment of the invention depicting the o-ring/string permanent connection and the loop of string, for the user's finger, as it passes through the center of the o-ring.
Figure 4:
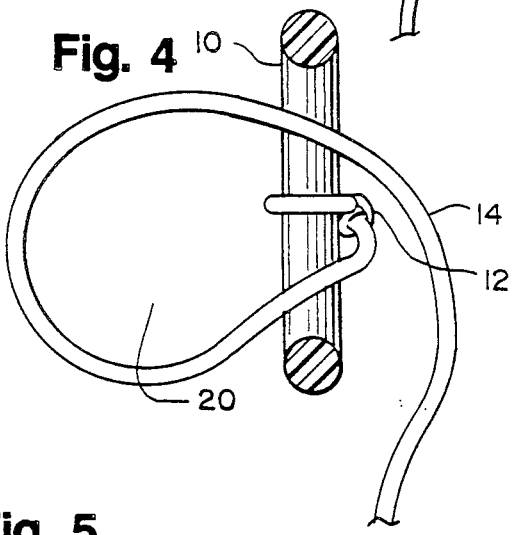
FIG. 4 is a cross section, taken along line 4—4, of a preferred embodiment of the invention, as shown in FIG. 3, depicting the o-ring/string permanent connection and the creation of the loop as it passes through the center of the o-ring.

As shown in FIGS. 2, 3 and 4, the string 14 is permanently connected to the resilient, rubberized or plastic o-ring 10 by means of a knot or like permanent connection 12.

As shown in FIGS. 3 and 4, the string 14 is looped and passed through the center of the resilient, rubberized or plastic o-ring 10 creating an opening 20 for the user's finger 22 (FIGS. 5, 6) to pass through.

The operation of the device for holding or controlling the bandalore or yo-yo type toy should now be apparent to those skilled in the field. From an inspection of FIGS. 5 and 6, it is seen that the user's finger 22 is passed through the opening 20, thus creating a closed loop made up of the string 14 and the resilient, rubberized or plastic o-ring 10. Once this connection is made, the user can hold and control the bandalore or yo-yo type toy 18.

Means are provided to guard against loss of circulation in the user's finger 22 while the bandalore or yo-yo type toy 18 is being used. In FIG. 5, the bandalore or yo-yo type toy 18 is thrown downwardly and the string 14 becomes taught. Due to the tension in the string 14, the resilient, rubberized o-ring 10 tightens and conforms to shape of the user's finger 22, thus holding the device steadfast to the user's finger 22. However, as shown in FIG. 6, when the bandalore or yo-yo type toy 18 begins its upward movement, or recoil, the string 14 relaxes and loses tension on it. Due to the loss of tension in the string 14, the resilient, rubberized o-ring 10 loosens about the user's finger 22, thus creating a comfortable fit which does not cut off circulation.

In keeping with one aspect of this invention, means are provided to assist in the return of the bandalore or yo-yo type toy 18 to the user's finger 22 when the invention is around the user's finger 22. In FIG. 5, because of the tension in the string 14, the resilient, rubberized o-ring 10 is stretched taught around the user's finger 22. When the bandalore or yo-yo type toy 18 reaches the bottom of its downward path and begins its upward movement, the resilient, rubberized o-ring 10 snaps back to its original shape (FIG. 6), providing an increase to the initial pull exerted by the user on the string 14 and the bandalore or yo-yo type toy 18.

In the past, only a string was used to hold or control a bandalore or yo-yo type toy. The string frequently became tangled around the center hub of the toy or was pulled into an opening of a yo-yo type toy, thus rendering the toy useless. The means are provided to prevent the invention from being pulled into the center hub or housing (not shown) of the bandalore or yo-yo type toy 18. As shown in FIGS. 7 and 8, the string 14, the resilient, rubberized or plastic o-ring 10 and the knot or like permanent connection 12 are prevented from being pulled into the opening 16 of a bandalore or yo-yo type toy 18 because of the physical size of the invention versus the opening 16 in the bandalore or yo-yo type toy 18.

Additionally, means are provided to allow the user to use the invention without passing a finger through the loop created by the string. In FIG. 9, the user's finger 22 passes directly through the resilient, rubberized or plastic o-ring 10 leaving the string 14, which is connected to the bandalore or yo-yo type toy 18, hanging directly from the knot or like permanent connection 12.

While the principles of the invention have been described above with specific apparatus and applications, it is only to be understood that this description is made only by way of example and not as a limitation on the scope of the invention.

I claim:

1. A device to hold or control a bandalore or yo-yo type toy, consisting of a resilient toroidal o-ring member composed of a rubberized flexible plastic o-ring and a string with opposite ends, said o-ring member being tied to one end of said string and said bandalore being tied to the opposite end of said string, and said string passes through said o-ring, whereby said string creates a loop to receive a user's finger, said string and o-ring forming a slip knot to removably secure the user's finger.

2. The device of claim 1 wherein said o-ring, string and loop connection surrounding said user's finger tightens about said user's finger when there is tension exerted upon said string.

3. The device of claim 1 wherein said o-ring, string and loop connection surrounding said user's finger loosens about said user's finger when there is no tension upon said string and said string is in a relaxed state.

4. The device of claim 1 wherein said o-ring and said string are permanently connected by means of a permanent knot.

5. The device of claim 2 wherein the o-ring will bend around and conform to the shape of the user'finger when said string and loop connection surrounding said user's finger tightens.

6. A method for controlling a yo-yo, said method comprising the steps of:

(a) securing one end of a yo-yo string to a resilient toroidal o-ring;

(b) looping said string through said o-ring to form a string loop for encircling a finger of the user whereby said string loop is held-in place by the resilience of said o-ring;

(c) throwing down said yo-yo whereby said o-ring becomes stretched around said finger thereby storing energy in said stretched o-ring;

(d) lifting said finger at the bottom of a downward excursion of said yo-yo whereby said energy stored in said stretched o-ring causes a quick return of said yo-yo, said o-ring losing the energy stored therein to loosening said string loop; and (e) lowering said finger at the top of an upward excursion of said yo-yo to repeat step (c).

* * * * *